US010594083B2

(12) United States Patent
Martinez et al.

(10) Patent No.: US 10,594,083 B2
(45) Date of Patent: Mar. 17, 2020

(54) SYSTEM FOR LOCKING A FITTING BASE OF A PLUG TO A PLUG, ASSOCIATED FITTING BASE AND PLUG

(71) Applicant: BULL SAS, Les Clayes Sous Bois (FR)

(72) Inventors: Patrice Martinez, Grenoble (FR); Franck Petretto, Vaulnaveys Le Bas (FR); Loris Bouzonnet, Saint Marcellin (FR)

(73) Assignee: BULL SAS, Les Clayes-sous-Bois (FR)

( * ) Notice: Subject to any disclaimer, the term of this patent is extended or adjusted under 35 U.S.C. 154(b) by 47 days.

(21) Appl. No.: 15/741,455

(22) PCT Filed: Jun. 23, 2016

(86) PCT No.: PCT/FR2016/051547
§ 371 (c)(1),
(2) Date: Jan. 2, 2018

(87) PCT Pub. No.: WO2017/006009
PCT Pub. Date: Jan. 12, 2017

(65) Prior Publication Data

US 2018/0366878 A1 Dec. 20, 2018

(30) Foreign Application Priority Data

Jul. 3, 2015 (FR) ..... 15 56327

(51) Int. Cl.
*H01R 13/639* (2006.01)

(52) U.S. Cl.
CPC ..... *H01R 13/6397* (2013.01); *H01R 2201/02* (2013.01); *H01R 2201/04* (2013.01);
(Continued)

(58) Field of Classification Search
CPC ..... H01R 13/6397; H01R 2201/02; H01R 2201/04; H01R 2201/06; H01R 2201/12; H01R 2201/18; H01R 2201/24
See application file for complete search history.

(56) References Cited

U.S. PATENT DOCUMENTS 6,799,981 B1 10/2004 Yu
2004/0219835 A1* 11/2004 Vielhaber ..... H01R 24/40 439/585

(Continued)

FOREIGN PATENT DOCUMENTS

DE 20 2008 013170 U1 3/2010
FR 2 847 388 A1 5/2004
JP 2010-103003 A 5/2010

OTHER PUBLICATIONS

International Search Report as issued in International Patent Application No. PCT/FR2016/051547, dated Sep. 27, 2016.

*Primary Examiner* — Abdullah A Riyami
*Assistant Examiner* — Nader J Alhawamdeh
(74) *Attorney, Agent, or Firm* — Pillsbury Winthrop Shaw Pittman LLP

(57) ABSTRACT

A fitting base of a plug includes a supporting element including at least one opening suitable for receiving at least one connector of the plug, a first stationary portion projecting from the supporting element, a first movable portion secured to the first stationary portion, the movable portion having a shape and dimensions suitable for the insertion thereof into a first cavity in the plug when the at least one connector of the plug is fitted in the at least one opening in the supporting element.

16 Claims, 5 Drawing Sheets

(52) U.S. Cl.
CPC ..... *H01R 2201/06* (2013.01); *H01R 2201/12* (2013.01); *H01R 2201/18* (2013.01); *H01R 2201/24* (2013.01)

(56) References Cited

U.S. PATENT DOCUMENTS

| | | | | |
|---|---|---|---|---|
| 2007/0004265 | A1* | 1/2007 | Yeh | H01R 13/6397 439/358 |
| 2011/0287649 | A1* | 11/2011 | Kurumizawa | B60L 53/68 439/304 |
| 2014/0235105 | A1* | 8/2014 | Friedhof | H01R 13/6461 439/607.55 |

* cited by examiner

SYSTEM FOR LOCKING A FITTING BASE OF A PLUG TO A PLUG, ASSOCIATED FITTING BASE AND PLUG

CROSS-REFERENCE TO RELATED APPLICATIONS

This is the U.S. National Stage of PCT/FR2016/051547, filed Jun. 23, 2016, which in turn claims priority to French Patent Application No. 1556327, filed Jul. 3, 2015, the entire contents of all applications are incorporated herein by reference in their entireties.

TECHNICAL FIELD OF THE INVENTION

The present invention relates to a system for locking a fitting base of a plug with a plug, a fitting base of a plug as well as a plug.

The invention finds a particularly interesting application in maintaining continuously electric supply for critical piece of equipment used for example in the medical field or in the computer world.

TECHNOLOGICAL BACKGROUND OF THE INVENTION

Some critical pieces of equipment such as hospital resuscitation apparatuses, or even computer servers should be continuously supplied with power. However, some incidents can occur in particular by a person which would inadvertently disconnect a plug supplying critical equipment. To overcome these incidents, many plugs and/or bases are provided with labels indicating the requirement not to disconnect the plug from its base. However, this solution is not efficient when this is an ill-intentioned or negligent person.

GENERAL DESCRIPTION OF THE INVENTION

Within this context, the invention aims at providing a system for locking a plugwith a fitting base, which is simple to make and having a cheap manufacturing cost.

According to a first aspect, the invention relates to a fitting base of a plug characterised in that it includes:

- a supporting element including at least one opening adapted to receive at least one connector of the plug,
- a first fixed part projecting from the supporting element,
- a first movable part integral with the first fixed part, said movable part having a shape and dimensions adapted to be introduced in a first cavity of the plug when the at least one connector of the plug is fitted into the at least one opening of the supporting element.

Such a fitting base is easy to make. Indeed, it is possible to manufacture said fitting base by simply fixing the first fixed part and the first movable part on a conventional fitting base. On the other hand, the manufacturing costs of such a fitting base are not high.

The fitting base according to the first aspect can also have one or more of the characteristics below, considered singly or according to any technically possible combinations.

According to a first non-limiting embodiment, the first fixed part is positioned on a periphery of the supporting element.

According to a non-limiting embodiment, the first fixed part extends along an axis y and the first movable part is movable along an axis substantially perpendicular to the axis y.

According to a non-limiting embodiment, the fitting base includes means for moving the first movable part.

According to a non-limiting embodiment, the means for moving the movable part include:

- a lock positioned on the first fixed part or on the first movable part,
- a key cooperating with the lock to displace the first movable part in the first cavity of the plug.

According to a non-limiting embodiment, the fitting base includes at least one second movable part having a shape and dimensions adapted to be introduced into at least one second cavity of the plug when the at least one connector of the plug is fitted into the at least one opening of the supporting element.

According to a second aspect, the invention relates to a plug including at least one first cavity provided in a sidewall of the plug, said first cavity having a shape and dimensions adapted to receive a first movable part of a fitting base of a plug when at least one connector of the plug is fitted into at least one opening of a supporting element of the fitting base.

The plug according to the invention is easy to make, only requiring to provide a cavity on a conventional plug. Thus, the costs committed in manufacturing such a plug are low.

The plug according to the second aspect can also have one or more of the characteristics below, considered singly or according to any technically possible combinations.

According to a non-limiting embodiment, the plug is an electrical plug.

According to a non-limiting embodiment, the plug is an antenna plug.

According to a non-limiting embodiment, the plug is an antenna plug.

According to a non-limiting embodiment, the plug includes at least one second cavity having a shape and dimensions adapted to receive at least one second movable part of the plug when the at least one connector of the plug is fitted into the at least one opening of the supporting element.

According to a third aspect, the invention relates to a system for locking a plug with a fitting base of a plug including:

- a fitting base of a plug according to the first aspect,
- a plug according to the second aspect of the invention.

Such a locking system is easy to make and to implement. The costs committed in manufacturing the fitting base and the plug are not high, therefore the locking system has thus a low cost.

The locking system according to the third aspect can also have one or more of the characteristics below, considered singly or according to any technically possible combinations.

According to a non-limiting embodiment, the first movable part of the fitting base includes:

- a locking position in which the first movable part is positioned in the first cavity,
- an unlocking position in which the first movable part is positioned outside the first cavity.

According to a non-limiting embodiment, switching from the locking position to the unlocking position and reversely is made by moving means for moving the first movable part.

According to a non-limiting embodiment, the first cavity has a rectangular shape adapted to receive the first movable part, one end of the first movable part having a rectangular shape.

According to a non-limiting embodiment, the first cavity includes at least two grooves adapted to receive the first movable part, one end of the first movable part having at least two teeth.

According to a non-limiting embodiment, the first movable part includes one bevelled end adapted to cooperate with the first cavity.

According to a non-limiting embodiment, the locking system includes tracking means constructed and arranged to transmit information about the position of the first movable part to a remote device and/or a driver of the first movable part by said remote device.

BRIEF DESCRIPTION OF THE FIGURES

The figures are only presented by way of indicating and in no way limiting purposes.

DETAILED DESCRIPTIONS OF EMBODIMENTS OF THE INVENTION

Unless otherwise set forth, a same element appearing in different figures has a single reference.

The invention relates, according to a first aspect, to a fitting base of a plug.

In the following of the description, it has been chosen to describe a fitting base 1 adapted to receive an electrical plug 2. In another embodiment, not represented, said fitting base 1 is adapted to receive an antenna plug or even a network plug.

Figure 1:
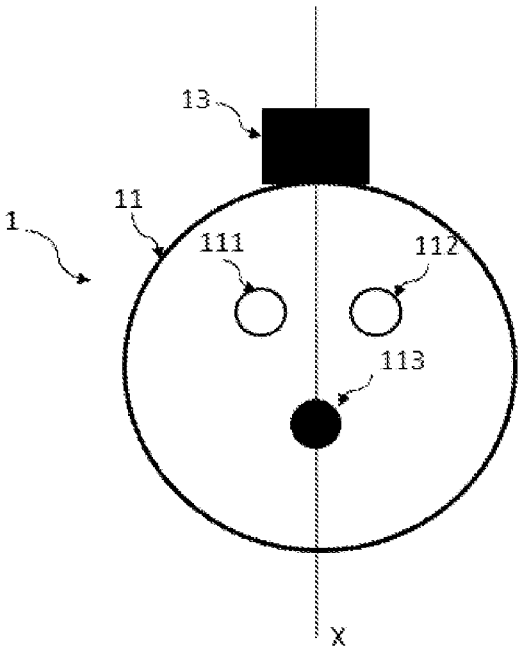
FIG. 1 is a schematic front view representation of a fitting base of a plug according to one embodiment of the invention, in an unlocking position.
Figure 2:
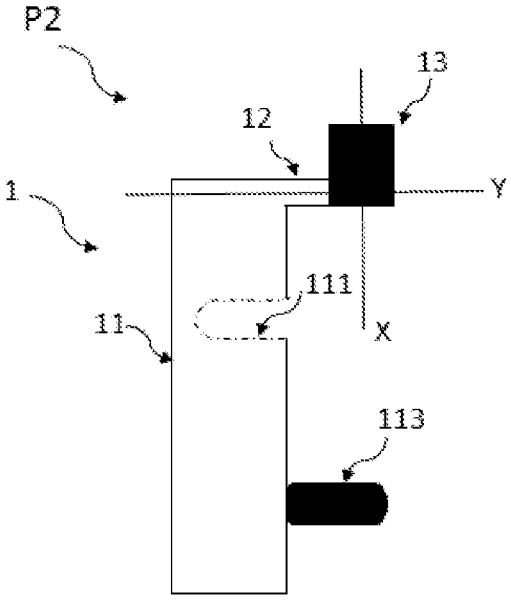
FIG. 2 is a schematic profile view representation of the fitting base of a plug presented in FIG. 1.
Figure 3:
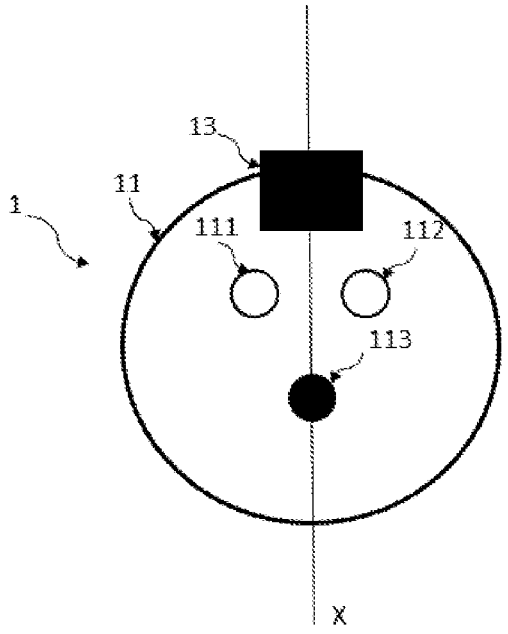
FIG. 3 is a schematic front view representation of the fitting base of a plug according to one embodiment of the invention, in a locking position.
Figure 4:
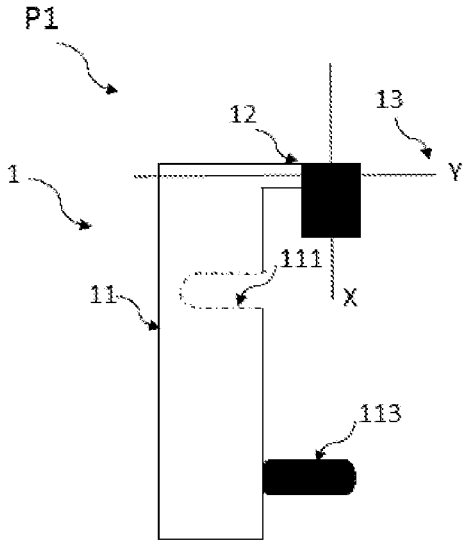
FIG. 4 is a schematic profile view representation of the fitting base of a plug presented in FIG. 4.

FIGS. 1 and 2 respectively represent a front view and a profile view of a fitting base 1 of a plug 2 in an unlocking position P2. FIGS. 3 and 4 respectively represent a front view and a profile view of the fitting base 1 of the electrical plug 2 in a locking position P1.

In reference to FIGS. 1 to 4, the fitting base 1 includes:

a supporting element 11, a first fixed part 12, a first movable part 13.

According to the embodiment presented in FIGS. 1 to 4, the supporting element 11, the first fixed part 12 and the first movable part 13 are integral with each other so as to form a single piece fitting base 1.

The supporting element 11 is in charge of dispensing an electric current when an electrical plug 2 is fitted into said supporting element 11.

The supporting element 11 of the fitting base 1 is, according to a first embodiment, directly fixed to a wall. In another embodiment, said supporting element 11 is fixed to one end of an extension cord. According to another embodiment, said supporting element 11 belongs to a "power bar" system which includes a plurality of fitting bases 1 according to the invention. According to another embodiment, the "power bar" system includes at least one fitting base 1 as well as conventional fitting bases (without a locking system).

In reference to FIGS. 1 and 3, the supporting element 11 includes a first opening 111, a second opening 112 and a first connector 113.

By "openings", it is meant herein blind holes including an electric contact at the bottom of said blind hole. An electric contact is a system enabling an electric current to flow by contact with a connector of an electrical plug.

The first opening 111 is intended to receive a third connector 202 of an electrical plug 2. The second opening 112 is intended to receive a second connector 201 of an electrical plug 2. The first connector 113 is intended to be introduced in a third opening 203 of an electrical plug 2. According to one embodiment, the supporting element 11 does not include a first connector 113.

The first fixed part 12 makes a support for the first movable part 13 enabling it to be positioned facing a first cavity 21 of an electrical plug.

The first fixed part 12 is fixed to a periphery of the supporting element 11 so as not to inhibit the electrical plug 2 from being introduced in the fitting base 1. In reference to FIGS. 2 and 4, the first fixed part 12 projects with respect to the supporting element 11 of the fitting base 1. Further, the fixed part 12 extends along an axis Y, said axis Y being perpendicular to an axis belonging to the plane of the supporting element 11. According to another embodiment, the first fixed part 12 extends along an oblique axis with respect to the axis belonging to the plane of the supporting element 11.

According to one embodiment, the first fixed part 12 is not movable with respect to the supporting element 11. According to another embodiment, the first fixed part 12 is movable with respect to the supporting element 11.

According to one embodiment, the fitting base 2 includes at least one second fixed part 12.

On the other hand, according to the embodiment shown in FIGS. 2 and 4, the first fixed part 12 has a rectangular shape. According to one embodiment, the length of the first fixed part 12 is between [1 cm to 2 cm], preferentially 1 cm.

The first movable part 13 is intended to be positioned in the first cavity 21 of the electrical plug 2 when the locking system 3 is in the locking position P1.

The first movable part 13 is fixed to the first fixed part 12 of the fitting base 1. On the other hand, the first movable part 13 is movable with respect to the first fixed part 12 as represented in FIGS. 2 and 4 respectively in the unlocking position P2 and the locking position P1. Indeed, in FIGS. 1 and 2, the first movable part 13 is in the unlocking position P2 in which said first movable part 13 is directed outwardly of the fitting base 1. In FIGS. 3 and 4, the first movable part 13 is in the locking position P1 in which said first movable part 13 is directed inwardly of the fitting base 1. Switching from the unlocking position P2 to the locking position P1 and reversely is made by a translation movement of the first movable part 13 along an axis X, perpendicular to the axis Y previously set forth.

According to another embodiment, the first movable part 13 is not movable with respect to the first fixed part 12. In this embodiment, it is the first fixed part 12 which is movable with respect to the supporting element 11 such that upon locking the fitting base 1 with the electrical plug 2, the first fixed part 12 is displaced to the electrical plug 2 such that the first movable part 13 is introduced into the first cavity 21 of the electrical plug 2.

Further, according to another embodiment, the fitting base 1 includes at least one second movable part fixed to the first fixed part 12. According to another embodiment, at least one second movable part is fixed to at least one second fixed part.

On the other hand, according to the embodiment shown in FIGS. 1 to 4, one end of the first movable part 13 has a rectangular shape adapted to be introduced in the first cavity 21 of the electrical plug 2. According to one embodiment, the first movable part 13 has a width in the range [3 mm to 5 mm], preferentially 5 mm. According to one embodiment, the first movable part 13 has a thickness within the range [2 mm to 5 mm], preferentially 3 mm.

According to another embodiment, one end of the first movable part 13 has at least two teeth adapted to be introduced in the first cavity 21 of the electrical plug 2.

According to one embodiment, one end of the first movable part 13 has a bevelled shape adapted to be introduced in the first cavity 21 of the electrical plug 2.

The invention relates, according to a second aspect, to a plug 2.

In the following of the description, it has been chosen to describe an electrical plug 2.

In another embodiment, the plug 2 is an antenna plug or even a network plug.

Figure 5:
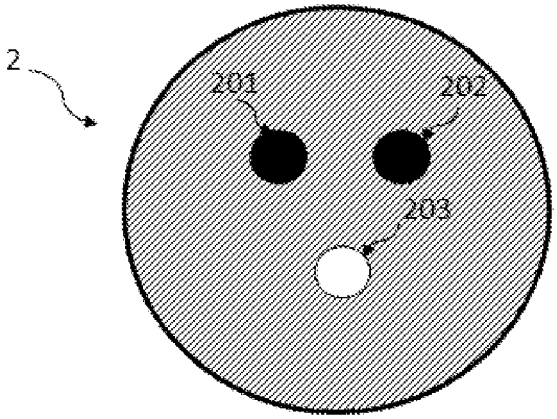
FIG. 5 is a schematic front view representation of the plug according to one embodiment of the invention.
Figure 6:
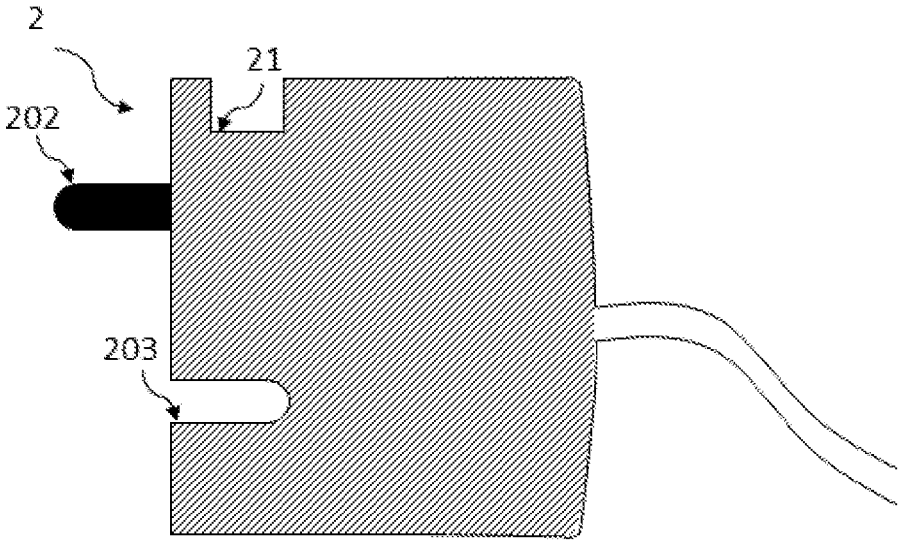
FIG. 6 is a schematic profile view representation of the plug presented in FIG. 5.

In reference to FIGS. 5 and 6, the electrical plug 2 includes:

the second connector 201,
the third connector 202,
the third opening 203,
the first cavity 21.

The second connector 201 and the third connector 202 as well as the third opening 203 of the electrical plug 2 are represented in FIG. 5. According to another embodiment, the electrical plug 2 does not include a third opening 203.

Upon fitting the electrical plug 2 into the fitting base 1, the second connector 201 is introduced in the second opening 112, the third connector 202 is introduced in the first opening 111 and the third opening 203 receives the first connector 113.

The first cavity 21 is intended to receive the first movable part 13 upon locking P1 the electrical plug 2 with the fitting base 1. Thus, the first cavity 21, represented in FIG. 6, is provided in the sidewall of the electrical plug 2 to be facing the first movable part 13 in the locking position P1.

On the other hand, according to the embodiment shown in FIG. 6, the first cavity 21 has a rectangular shape adapted to receive a first movable part 13 of the fitting base 1. According to one embodiment, the first cavity 21 has a length within the range [3 mm to 5 mm]. According to one embodiment, the first cavity 21 has a thickness within the range [2 mm to 5 mm], preferentially 3 mm.

According to one embodiment, the electrical plug 2 includes at least one second cavity adapted to receive at least one second movable part.

According to another embodiment, the first cavity 21 has at least two grooves adapted to receive the first movable part 13 of the fitting base 2.

The invention relates, according to a third aspect, to a locking system 3 of the fitting base 1 represented in FIGS. 1 to 4 with the electrical plug 2 represented in FIGS. 5 and 6.

In the following of the description, it has been chosen to describe a locking system 3 of an electrical plug 2 with a fitting base 1 of an electrical plug 2. In another embodiment, the locking system 3 is adapted for locking an antenna plug with a fitting base 1 of an antenna plug. In another embodiment, the locking system 3 is adapted for locking a network plug with a fitting base of a network plug.

The locking system 3 includes:

a locking position P1 in which the first movable part 13 is positioned in the first cavity 21,
an unlocking position P2 in which the first movable part 13 is positioned outside the first cavity 21.

Figure 7:
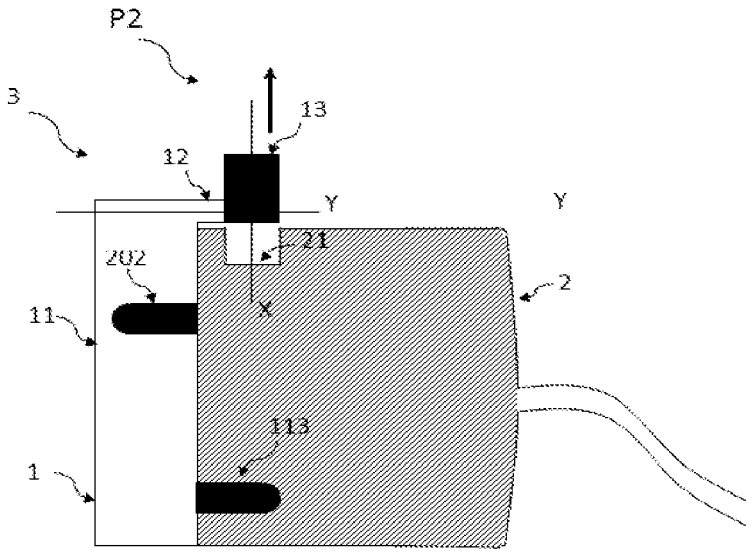
FIG. 7 is a schematic representation of the locking system for the fitting base of the plug with the plug according to one embodiment, in an unlocking position.

FIG. 7 represents the locking system 3 of the fitting base 1 with the electrical plug 2 in an unlocking position P2.

Thus, when the electrical plug 2 is fitted into the fitting base 1, the first movable part 13 is in the unlocking position P2. In reference to FIG. 6, the first movable part 13 is directed outwardly of the fitting base 1 so as to let the electrical plug 2 pass when it comes to be fitted into the fitting base 1.

According to one embodiment, during the unlocking position P2, the first fixed part 12 is movable with respect to the supporting element 12 such that it can be positioned at an oblique angle with respect to the axis Y and thus let the electrical plug 2 fit into the fitting base 1.

Figure 8:
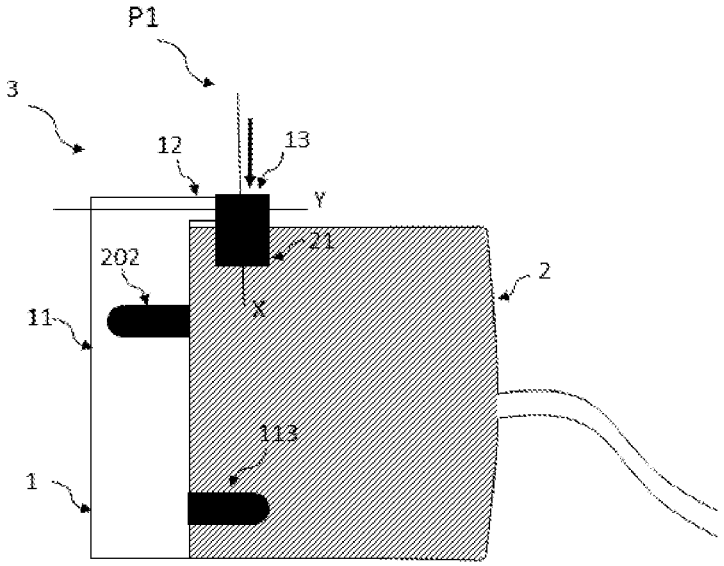
FIG. 8 is a schematic representation of the locking system presented in FIG. 7, in a locking position.

FIG. 8 represents the locking system 3 of the fitting base 1 with the electrical plug 2 in a locking position.

In reference to FIG. 8, in the locking position P1, the first movable part 13 is introduced in the first cavity 21 of the electrical plug 2. Thus, if a person attempts to disconnect the electrical plug 2 from the fitting base 1 along an axis parallel to the axis Y, the end of the first movable part 13 abuts against the internal wall of the first cavity 21. Therefore, the electrical plug 2 cannot be disconnected. On the other hand, since the shape and dimensions of the first cavity 21 are substantially identical to the end of the electrical plug 2, the second connector 201, the third connector 202 and the third opening 203 remain in contact, respectively, with the second opening 112, the first opening 111 and the third connector 113.

Switching from the locking position P1 to the unlocking position P2 and reversely is made by moving means 14 for moving the first movable part 13.

Figure 9:
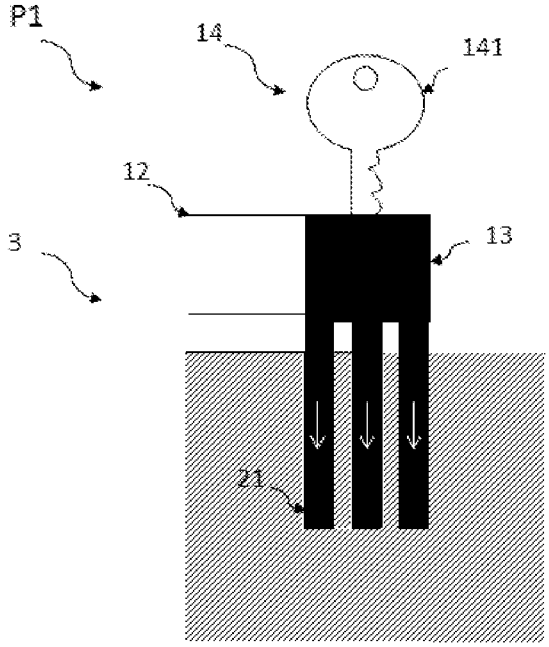
FIG. 9 is a schematic representation of the first movable part of the fitting base in the locking position in the first cavity of the plug according to a first embodiment of the invention.

According to the embodiment shown in FIGS. 8 and 9, the moving means 14 include:

a lock (not represented in the FIGS.) positioned on the first movable part 13,
a key 141 cooperating with the lock to displace the first movable part 13 in the first cavity 21 of the electrical plug 2.

According to another embodiment which is not represented, the lock is positioned on the first fixed part 12.

Thus, rotating the key 141 in the lock of the moving means 14 enables the first movable part to be displaced along the axis X, activating the locking position P1 or the unlocking position P2.

FIG. 9 represents the first movable part 13 in the locking position P1 in the first cavity 21 according to a first embodiment of the invention.

In reference to FIG. 9, the first cavity 21 has three grooves. The end of the first movable part 13 has three teeth.

Thus, in the locking position P1, each tooth of the first movable part 13 is fitted into the corresponding groove of the first cavity 21.

Figure 10:
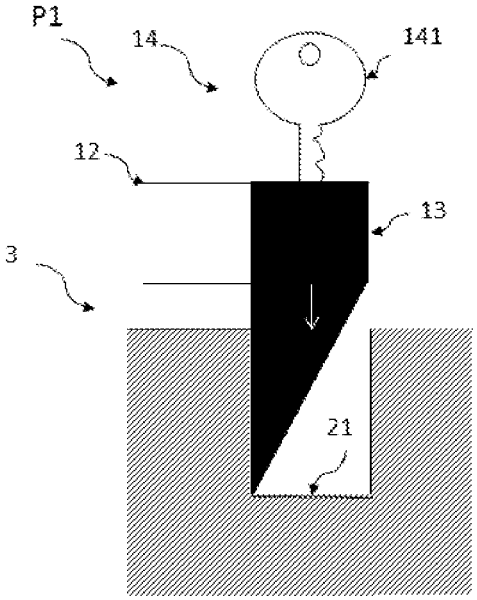
FIG. 10 is a schematic representation of the first movable part of the fitting base in the locking position P1 in the first cavity of the plug according to a second embodiment of the invention.

FIG. 10 represents the first movable part 13 in the locking position P1 in the first cavity 21 according to a second embodiment of the invention.

In reference to FIG. 10, the end of the first movable part 13 has a bevelled shape and the first cavity 21 has a rectangular shape. According to another embodiment which is not represented, the first cavity 21 has a bevelled shape.

In this embodiment, the bevelled end of the first movable part 13 is kept projecting from the first fixed part 12 by a spring placed at the end of the first movable part 13. Thus, when the electrical plug 2 is moved closer to the fitting base 1, the electrical plug 2 contacts a first wall of the bevelled end of the first movable part 13. The pressure applied by the electrical plug 2 to the bevelled end of the first movable part 13 causes said first movable part 13 to make a translation movement directed outwardly of the base 1. Thus, when the electrical plug 2 is fitted into the supporting element 1, the first movable part 13 comes to be introduced in the first cavity 13 to lock the fitting base 1 with the electrical plug 2. Thus, if a person attempts to disconnect the electrical plug 2 from the fitting base 1 along an axis parallel to the axis Y, the second wall of the bevelled end abuts against the internal wall of the first cavity 21.

On the other hand, according to a non-limiting embodiment, the locking system 3 includes tracking means enabling information about the position of the first movable part 13 to be transmitted to a remote device. The tracking means also enable the first movable part 13 to be driven by the remote device in order to lock or unlock the electrical plug 2 to or from its fitting base 1. By "remote device", it is meant a computer for example.

The invention claimed is:

1. A fitting base of a plug, comprising:

a supporting element including at least one opening adapted to receive at least one connector of the plug, a first fixed part projecting from the supporting element and extending along a longitudinal axis (y), a first movable part integral with the first fixed part, said first movable part being movable in translation along an axis (x) substantially perpendicular to the longitudinal axis (y) of the first fixed part and having a shape and dimensions adapted to be introduced in a first cavity of the plug when the at least one connector of the plug is fitted into the at least one opening of the supporting element.

2. The fitting base of a plug according to claim 1, wherein the first fixed part is positioned on a periphery of the supporting element.

3. The fitting base of a plug according to claim 1, further comprising moving means for moving said first movable part.

4. The fitting base of a plug according to claim 3, wherein the moving means for moving the movable part include:

a lock positioned on the first fixed part or on the first movable part, a key cooperating with the lock to displace the first movable part in the first cavity of the plug.

5. The fitting base of a plug according to claim 1, further comprising at least one second movable part having a shape and dimensions adapted to be introduced into at least one second cavity of the plug when the at least one connector of the plug is fitted into the at least one opening of the supporting element.

6. A plug comprising at least one first cavity provided in a sidewall of the plug, said first cavity having a shape and dimensions adapted to receive at least one first movable part of a fitting base of a plug when at least one connector of the plug is fitted into at least one opening of a supporting element of the fitting base; further comprising at least one second cavity having a shape and dimension adapted to receive at least one second movable part of the plug when the at least one connector of the plug is fitted into the at least one opening of the supporting element.

7. The plug according to claim 6, wherein the plug is an electrical plug.

8. The plug according to claim 6, wherein the plug is an antenna plug.

9. The plug according to claim 6, wherein the plug is a network plug.

10. A locking system for a fitting base of a plug with a plug comprising:

a fitting base of a plug according to claim 1, and the plug.

11. The locking system according to claim 10, wherein the first movable part of the fitting base includes:

a locking position in which the first movable part is positioned in the first cavity, an unlocking position in which the first movable part is positioned outside the first cavity, wherein switching from the locking position to the unlocking position and reversely is made by moving means for moving the first movable part.

12. The locking system according to claim 10, wherein the first cavity has a rectangular shape adapted to receive the first movable part, one end of the first movable part having a rectangular shape.

13. The locking system according to claim 10, wherein the first cavity includes at least two grooves adapted to receive the first movable part, one end of the first movable part having at least two teeth.

14. The locking system according to claim 10, wherein the first movable part includes one bevelled end adapted to cooperate with the first cavity.

15. The locking system according to claim 10, further comprising a tracking system constructed and arranged to transmit information about the position of the first movable part to a remote device and/or a driver of the first movable part by said remote device.

16. The fitting base of a plug according to claim 1, wherein the first fixed part is fixed relative to the supporting element.

* * * * *